US011856373B2

(12) United States Patent
Fish

(10) Patent No.: US 11,856,373 B2
(45) Date of Patent: Dec. 26, 2023

(54) HEADSET MODEL IDENTIFICATION WITH A RESISTOR

(71) Applicant: Plantronics, Inc., Santa Cruz, CA (US)

(72) Inventor: Dennis S. Fish, Santa Cruz, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 269 days.

(21) Appl. No.: 17/160,146

(22) Filed: Jan. 27, 2021

(65) Prior Publication Data

US 2022/0240034 A1 Jul. 28, 2022

(51) Int. Cl.
*H04R 29/00* (2006.01)

(52) U.S. Cl.
CPC ..... *H04R 29/001* (2013.01); *H04R 2420/05* (2013.01)

(58) Field of Classification Search
CPC ..... H04R 29/001; H04R 2420/05
USPC ..... 381/58, 56, 150, 111, 122; 73/584, 73/204.25
See application file for complete search history.

(56) References Cited

U.S. PATENT DOCUMENTS 8,412,268 B2 4/2013 Inha ..... 455/557
9,148,720 B2 9/2015 Li et al.
2005/0053243 A1* 3/2005 Ganton ..... H04R 5/04 381/77
2008/0112572 A1* 5/2008 Wong ..... H04R 5/04 381/74
2009/0147134 A1 6/2009 Iwamatsu
2014/0010381 A1 1/2014 Doy
2017/0245073 A1 8/2017 Agarwal et al.
2022/0191634 A1* 6/2022 Khelfa ..... G10L 25/51

FOREIGN PATENT DOCUMENTS

CN 111654799 A 9/2020
EP 2280560 A1 2/2011
EP 2560413 A1 2/2013
EP 2637423 A1 9/2013
EP 3179738 A1 6/2017
WO 2004/001552 A2 12/2003

* cited by examiner

*Primary Examiner* — Vivian C Chin
*Assistant Examiner* — Con P Tran
(74) *Attorney, Agent, or Firm* — Quarles & Brady LLP

(57) ABSTRACT

An apparatus includes a wire connector configured to receive a connection to an external device. The external device includes a speaker and is configured to output audible sounds. The apparatus includes a connection detection circuit configured to determine whether the external device has connected to the apparatus through the wire connector. The apparatus includes an output test circuit configured to, upon detection of a connection to the external device, issue a test signal to the external device, evaluate a response to the test signal, the response based upon a resistance value within the external device, and determine an identity of the external device based upon the response to the test signal.

22 Claims, 2 Drawing Sheets

HEADSET MODEL IDENTIFICATION WITH A RESISTOR

FIELD OF THE INVENTION

The present disclosure relates to providing audio headsets and speakers and, more particularly, to a method and system for headset model identification with a resistor.

BACKGROUND

Modern headsets are used to provide audio input and output into a variety of electronic devices. These headsets typically include both speakers and microphones. Moreover, the electronic devices to which the headsets are connected may apply a variety of settings to input and output from the headsets, such as overall gain, frequency-specific gain, filtering, or any other suitable signal conditioning. Moreover, the electronic devices may apply settings to input and output from the headsets to match criteria or requirements of software interfacing with the headset. In order to apply the settings, the electronic devices may store a tuning file, set of registers, or other information characterizing a given headset or signal conditioning that is to be applied to a given headset. Thus, identification of the given headset may be used in order to properly apply the correct settings to input or output from the given headset.

Inventors of embodiments of the present disclosure have discovered that other solutions for identifying a headset have the disadvantage of requiring a memory or other integrated circuit embedded in the headset or headset connectors in order to identify the headset. This kind of approach may require additional signal connections or wires in the cable and thus additional contacts in the connector. This kind of approach also requires additional circuitry in the adapter or base of the electronic device which increases the cost and complexity of both the adaptor or base and the headset itself. Embodiments of the present disclosure may address one or more of these shortcomings of other approaches.

SUMMARY

Embodiments of the present disclosure may include an apparatus, such as a host device. The apparatus may include a wire connector configured to receive a connection to an external device. The external device may include a speaker configured to output audible sounds. The apparatus may include a connection detection circuit configured to determine whether the external device has connected to the apparatus through the wire connector. The apparatus may include an output test circuit configured to, upon detection of a connection to the external device, issue a test signal to the external device, evaluate a response to the test signal, the response based upon a resistance value within the external device, and determine an identity of the external device based upon the response to the test signal.

Embodiments of the present disclosure may include another apparatus. The other apparatus may implement the external device as discussed above. The other apparatus may include a speaker configured to output audible sounds, a wire connector configured to receive a connection to a host device and receive test signals to identify the apparatus, and an identifier resistor connected between an input to the speaker and ground. A resistance value of the identifier resistor may be configured to identify the apparatus in response to the test signals.

Embodiments of the present disclosure may include methods performed by any of the apparatuses of the above embodiments.

DETAILED DESCRIPTION

Figure 1:
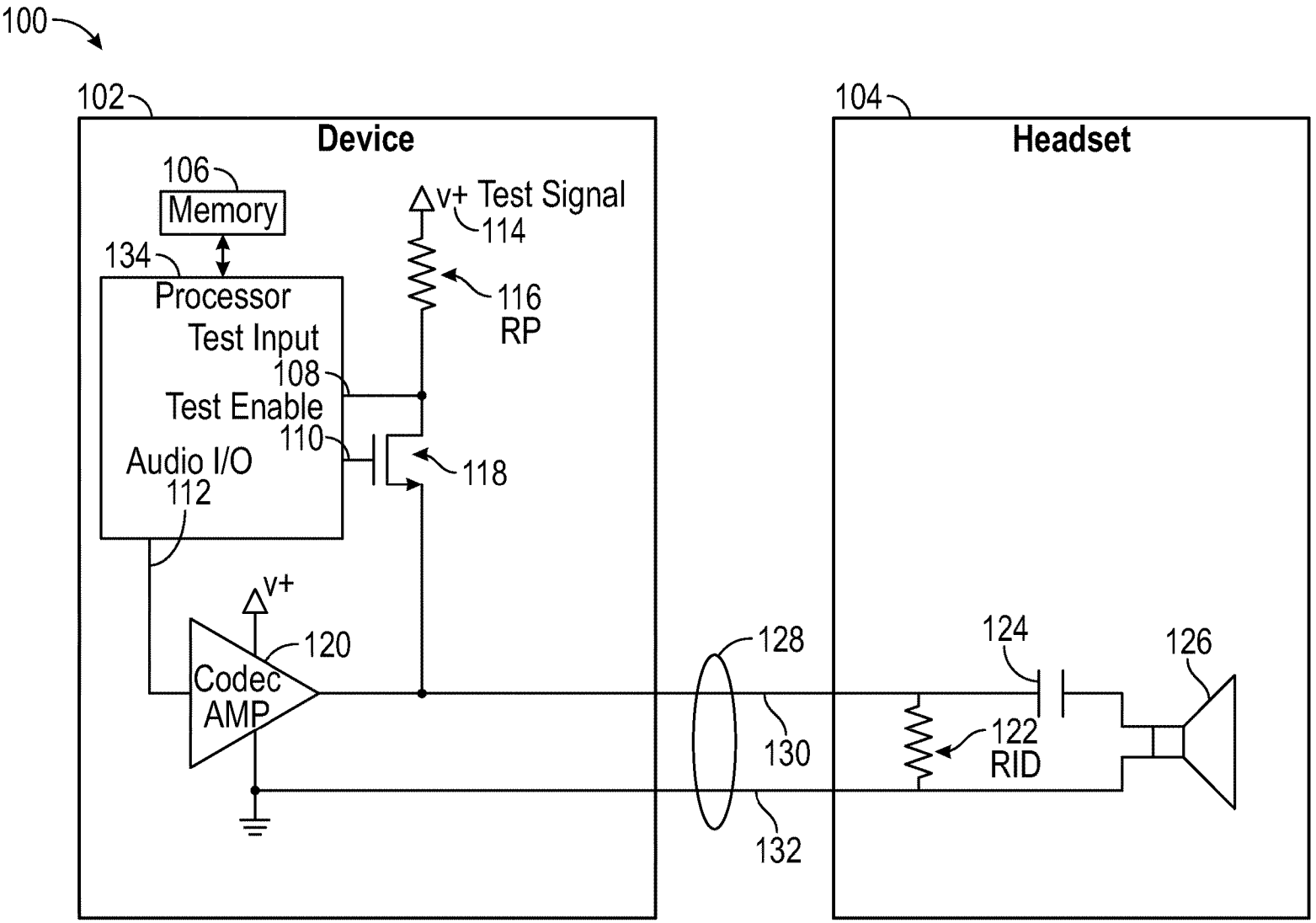
FIG. 1 is an illustration of an example system for identifying a model of a headset, according to embodiments of the present disclosure.

FIG. 1 is an illustration of an example system 100 for identifying a model of a headset, according to embodiments of the present disclosure.

System 100 may include any suitable number and kind of components. System 100 may include an electronic device 102 and a headset 104. Electronic device 102 may include, for example, a computer, a smartphone, a server, a laptop, a personal data assistant, a consumer electronic device, an appliance, an infotainment device, a vehicle audio device, or any other suitable electronic device. Headset 104 may include earphones, speakers, microphones, or any other suitable device for audio input, audio output, or audio input/output.

Electronic device 102 and headset 104 may be communicatively coupled in any suitable manner, such as through a connection 128. Connection 128 may include any suitable communication protocol, wiring, cabling, or other manner of communicatively coupling electronic device 102 and headset 104. In the example of FIG. 1, a dual pair of transmission/reception lines are shown as example connections. A first line 130 may include a signal line, and a second line 132 may include a shared ground line. Additional lines of communication, not shown, may be included in connection 128.

Electronic device 102 may include any suitable number and kind of components. Electronic device 102 may include a processor 134 communicatively coupled to a memory 106. Memory 106 may include instructions that, when loaded and executed by processor 134, perform various functionality such as the configurations of processor 134 described in the present disclosure. Moreover, these instructions may constitute software that is executed and may make use of interfacing with headset 104. In the example of FIG. 1, processor 134 may perform both interfacing with headset 104 and execution of such software. In other embodiments, processor 134 may perform interfacing with headset 104 on behalf of software executing elsewhere in system 100 or electronic device 102 (not shown). Processor 134, along with other components of electronic device 102 discussed below that may be used to identify a model of headset 104, may constitute a test circuit. The test circuit and processor 134 may be implemented in any suitable manner, such as by a microprocessor, a core of a microprocessor, a microcontroller, a field programmable gate array, an application-specific interface circuit, digital circuitry, analog circuitry, or any suitable combination thereof.

Processor 134 may include any suitable inputs and outputs. Processor 134 may include a test signal output 114. Test signal output 114 may be configured to generate any suitable test signal, whether constant or periodic. For example, test signal output 114 may be configured to generate a known voltage output. Test signal output 114 may be, for example, a positive reference voltage given as V+. In one example, such as shown in FIG. 1, test signal output 114 may be generated outside of processor 134.

Processor 134 may include a test enable output 110. Test enable output 110 may be configured to indicate whether or not a test to identify a model of a connected headset, such as headset 104, is to be performed. This may reflect whether system 100 is in a test mode or a normal mode. In a test mode, processor 134 may enable test enable output 110 and a test to identify a model of headset 104 may be performed. Other audio input or output to headset 104 may be disabled during the test mode. In a normal mode, processor 134 may disable test enable output 110 and a test to identify a model of headset 104 might not be performed. Other audio input or output to headset 104 may be enabled during the normal mode. Test enable output 110 may be configured to be enabled when logic high or when logic low, according to the particular design of the rest of electronic device 102 and switch 118.

Processor 134 may include an audio I/O 112. Audio I/O 112 may be configured to generate audio output for headset 104 or receive audio input from headset 104. Audio I/O 112 may be of any suitable format or protocol. Audio I/O 112 may be configured to be enabled during normal mode and to be disabled during test mode.

Electronic device 134 may include additional audio processing components for audio I/O. For example, electronic device 134 may include a codec amplifier 120 configured to generate output signals on connection 128 to headset 104 based on audio I/O 112. Analogous input processing components may be included in electronic device 102 but not shown. Codec amplifier 120 may be included in or may be separate from processor 134.

Electronic device 102 may include additional components to perform testing for the identity of headset 104. For example, electronic device 102 may include a pull-up resistor such as RP 116 and a switch such as switch 118. RP 116 may be connected at one end to test signal output 114. RP 116 may be connected at another end to switch 118. Moreover, test signal output 114 may be connected to the top of RP 116. When switch 118 is activated, test signal output 114 may be applied (with a voltage drop across RP 116) to line 130.

Switch 118 may be implemented in any suitable manner, such as by a transistor such as a metal oxide semiconductor field effect transistor (MOSFET). Switch 118 may be configured to route the signal on its top side (or source pin), connected to the bottom of RP 116 and thus receiving test signal output 114 as-reduced by RP 116, to its bottom side (or drain pin), based on a signal to its switch enable input (or gate pin). Switch 118 may be connected at its drain pin to line 130 of connection 128. Thus, switch 118 may be configured to, upon being enabled by test enable output 110, to route the series of test signal output 114 and RP 116 to line 130. This may occur in test mode. Also, during test mode, output from audio I/O 112 may be disabled. Thus, the signal travelling through line 130 during test mode may be test signal output 114, less voltage drops across RP 116 and switch 118. Switch 118 may be configured to, upon being disabled by test enable output 110, to stop routing the series of test signal output 114 and RP 116 to line 130. This may occur during normal mode. Also, during normal mode, output from audio I/O 112 may be enabled. Thus, the signal travelling through line 130 during normal mode may be audio I/O 112 as-conditioned by codec amplifier 120.

Headset 104 may be implemented in any suitable manner. Headset 104 may include a suitable speaker, microphone, or any combination thereof, represented as speaker 126 in FIG. 1. Moreover, speaker 126 may include a nominal resistance, RS. However, this resistance may be blocked from being measured by processor 134 by capacitor 124, such that only RID 122 is measured in test mode.

Headset 104 may include a resistor connected between lines 130, 132. This resistor may be given as RID 122. RID 122 may be configured to uniquely identify a model of headset 104 among other models of headsets.

Headset 104 may include a capacitor 124. Capacitor 124 may be connected along line 130 between a first end of RID 122 and a terminal of speaker 126.

Although headset 104 may include other circuitry, memory, or other mechanisms of identifying its model, other than RID 122, these might not be used for identifying the model of 104 in the present example.

In one embodiment, electronic device 102 may be configured to identify the resistance value of RID 122 to identify the model of headset 104. The resistance value of RID 122 may be determined in any suitable manner. For example, electronic device 102 may apply a known voltage or voltage on line 130 and measure the resulting current or voltage at test input circuit 108, and using this to calculate RID 122.

Electronic device 102 may include any suitable components for measuring the voltage or current on RID 122. For example, electronic device 102 may include a test input circuit 108. Test input circuit 108 may be implemented in any suitable manner, such as by an analog to digital converter (ADC), digital circuitry, analog circuitry, or any suitable combination thereof. Test input circuit 108 may be configured to measure the voltage or current across connection 128. Test input circuit 108 may be connected between a bottom of RP 116 and a top of switch 118. Thus, test input circuit 108 may measure the voltage drop across the resistance of headset 104 (which may be RID 122). This voltage may be determined as part of a voltage divider circuit, given test signal output 114 applied across RP 116 and the resistance of headset of 104 (which may be RID 122), the resultant voltage at the bottom of RP 116 measured by test input circuit 108. Voltage drops across switch 118 may be taken into account into the voltage measurement to determine the voltage drop across the resistance of headset of 104 (which may be RID 122).

In another example, electronic device 102 may include sensor (not shown) configured to measure the voltage or current across connection 128, including across lines 130, 132. The sensor may be configured to provide results to a test input (not shown) on processor 134. The sensor may be implemented as a voltage sensor, a current sensor, or any other suitable sensor, including components such as an analog to digital converter (ADC), digital circuitry, analog circuitry, or any suitable combination thereof. The sensor may be implemented within processor 134 or separate from processor 134. The sensor may be configured to provide its output to any suitable portion of processor 134.

Processor 134 may be configured to, based upon the current or voltage measured by test input circuit 108 and upon the current or voltage issued through test signal output 114, determine the value of RID 122. This may be further based upon known resistances of RP 116 and any voltage drops or resistances of switch 118. This analysis may be performed on the basis of Ohm's law (voltage=current*resistance). For the purposes of efficiency, electronic device may use the resulting current or voltage received through test input circuit 108 to look up predefined current or voltage values that correspond to known possible values of RID 122. These may be recorded, for example, in a lookup table or other suitable memory. Given the measurement from test input circuit 108, processor 134 may be configured to calculate RID 122 or look up the value of RID 122. The value of RID 122 may be associated with a given model of headset 104. The value of RID 122 tuning file, settings, or other information may be retrieved and applied by electronic device 102 with audio conditioning in subsequent operation in normal mode to audio I/O 112. In some embodiments, the actual value of RID 122 might not be explicitly determined, wherein the RID 122 tuning file, settings, or other information is indexed by the value of the current or voltage received through test input circuit 108, without performing an intermediate step of explicitly determining the actual resistance value of RID 122, although such a process may nonetheless be based upon the resistance value of RID 122.

Thus, in one embodiment a single passive resistor, such as RID 122, may be placed in headset 104. In another embodiment, RID 122 may be continuously connected between lines 130, 132 in both normal mode and in test mode. The resistance value of RID 122 may be chosen so as not have any adverse effect on the audio signals traversing connection 128 to or from audio I/O 112 in the normal mode. This may allow RID 122 to be permanently connected between lines 130, 132. Otherwise, RID 122 might be selectively switched between being connected between lines 130, 132 in test mode and not connected between lines 130, 132 in normal mode.

Electronic device 102 may include any suitable analog circuitry, digital circuitry, instructions for execution by a processor, or any combination thereof (not shown), to determine whether headset 104 has been connected to electronic device 102. Electronic device 102 may thus determine whether headset 104 has been connected to electronic device 102 and then begin the process of identifying a model of headset 104. Detection of connection of headset 104 may be made by determining, specifically, that an instance of a headset 104 has been connected, or by determining, more generally, that any device has been connected to electronic device 102. For example, detections of headset 104 connection may be based upon detecting that a USB device has connected to electronic device 102.

Operation of the test mode to identify the model of headset 104 may be performed in a manner that is suitably fast such that a human user of system 100 might not notice an appreciable delay in such an identification. For example, the test mode and identification of the model of headset 104 may be performed after a delay of approximately 60 milliseconds. The time needed to perform test mode may be based in part upon the values of capacitor 124, RID 122, RP 116, and resistance of speaker 126.

Capacitor 124 may be configured to prevent any resistance of speaker 126 from being measured by test input circuit 108 as part of the response to test signal 114, during the time required to charge capacitor 124. Thus, during this charge time, test signals on line 130 in test mode might not experience any voltage drop across speaker 126 due to resistance of speaker 126. Thus, the test mode may be completed after the charge time of capacitor 124. Capacitor 124 may have a capacitance of, for example, 15 g. Capacitor 124 may have a −3 dB effect at 88 Hz.

As described above, RP 116 may be configured to act as a pull-up resistor between line 130 and a positive voltage reference, selectively applied during test mode by switch 118. RP 116 may be configured to provide part of a voltage divider circuit, in series with RID 122 during test mode, so that the voltage drop across RID 122 may be measured. RP 116 may have any suitable resistance value. Higher values for RP 116 may cause a longer settling time, as RP 116 may affect the time constant for capacitor 125. However, low values for RP 116 may reduce the possible range of usable values for RID 122, as the voltage divider circuit would otherwise be dominated by RID 122 in view of RP 116. An example value for RP 116 may be, for example, 1,000Ω.

The possible values of RID 122 may be selected so as to allow for accurate voltage or current measurements. The specific values of RID 122 within such a range may be selected to uniquely identify headset 104 among other instances of headset 104, such as a model of headset 104. For example, RID 122 may be between 499 12.1 kΩ. Lower values may cause a slight reduction in sensitivity, such as a loss of 0.5 dB. Moreover, values that are too low may redirect too much power away from speaker 126. Higher values may cause an increase in settling time, as RID 122 may contribute to the time constant of capacitor 124. Moreover, values that are too large may cause electromagnetic interference or other noise. The possible different values of RID 122 may be established by the accuracy of the resistance values of RID 122, and the accuracy of sampling of test input circuit 108. Different models of headset 104 may include resistance values that differ from each other in amount so that they may be sufficiently and accurately distinguished from each other by processor 134.

If a different instance of a headset is connected to electronic device 102, wherein such a headset does not include an instance of RID 122 or capacitor 124, the measured current or voltage may be made of, for example, the resistance value of an instance of the equivalent of speaker 126. In such a case, the measured voltage or current or the determined resistance may be of the resistance value of such a speaker. Such a measurement or determined value might not be located in look-up tables or other structures of electronic device 102. Moreover, such a measurement or determined value might be established in a look-up table or other structure of electronic device 102 as not having an instance of RID 122. If no corresponding value is found in the look-up table, electronic device 102 may handle the headset in a default manner with, for example, default settings. Similarly, if a measurement or determined value corresponds to a headset that does not have an instance of RID 122, electronic device 102 may handle the headset in a default manner with, for example, default settings.

Figure 2:
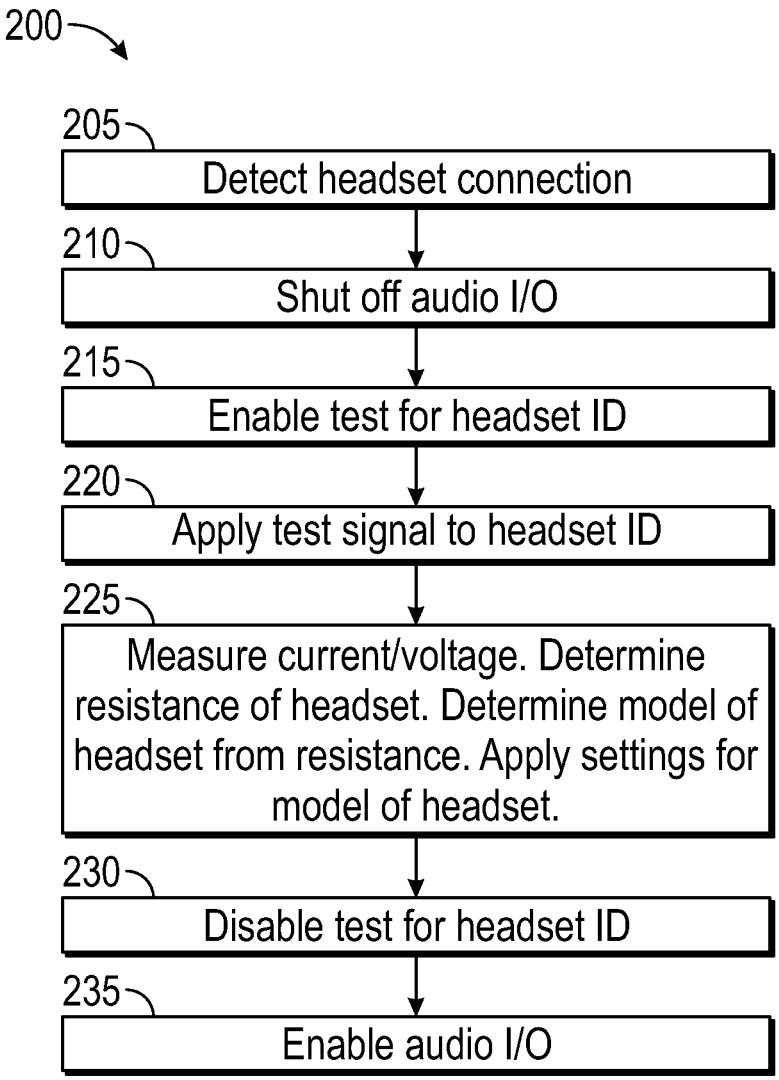
FIG. 2 is an illustration of an example method for identifying a model of a headset, according to embodiments of the present disclosure.

FIG. 2 is an illustration of an example method 200 for identifying a model of a headset, according to embodiments of the present disclosure. Method 200 may be performed by any suitable apparatus, such as the system 100 of FIG. 1. More specifically, method 200 may be performed by a test circuit or a test circuit including processor 134 and other associated elements of FIG. 1. Method 200 may begin at any suitable step such as step 205. Method 200 may include more or fewer steps than shown in FIG. 2. Method 200 may optionally repeat, omit, or perform steps in a different order as shown in FIG. 2 consistent with the teachings of the present disclosure. Method 200 may be configured recursively, and system 100 may be configured to perform multiple instances of method 200 in parallel. Method 200 may be performed upon any suitable event, signal, or command, such as a new or renewed connection of a headset into an electronic device, reboot, on demand by a user, periodically, as part of a diagnostic routine, or any other suitable criteria.

At 205, a headset connection may be determined. This determination may be made in any suitable manner, such as detection of a particular voltage, current, or resistance value on a connection from the headset to an electronic device, a command, an interrupt, or any other suitable criteria.

At 210, audio I/O may be turned off, if it has not already been turned off or otherwise disabled.

At 215, a test for a headset identifier may be enabled. This may include issuing a logic signal to a switch.

At 220, a test signal may be applied to the headset. This may include routing the test signal through the switch enabled in 215 to a connection between the electronic device and the headset. 220 and 215 may be performed in any suitable order or in parallel. The test signal may include a known current or voltage. Inside of the headset, the test signal may be applied to one or more identifying resistors. Circuitry, such as a capacitor, may shield the test signal from other components of the headset, such as microphones or speakers.

At 225, current or voltage resulting from applying the test signal to the headset may be measured. The current or voltage may be measured on a connection between the headset and the electronic device. From the measured current or voltage, a resistance of the headset may be identified. This may include identifying the resistance of the identifying resistors, or the resistance may be implied from a look-up of the measured current or voltage. From the measured current or voltage, a model of the headset may be determined. This determination may be implicit or explicit. For example, based on the measured current or voltage, or a resistance value determined from the measured current or voltage, a model of the headset may be identified in a table. In another example, the model of the headset may be inferred as the measured current or voltage, or the resistance value determined from the measured current or voltage is used to access corresponding settings for the headset. The corresponding settings for the headset may be accessed or identified by any suitable one or combination of the measured current or voltage, identified resistance, or identified model of headset. The settings may be applied in the system for use with the headset.

At 230, the test for the headset identifier may be disabled. This may include issuing a logic signal to a switch.

At 235, audio input and output may be enabled. Input and output to the headset may be performed using the settings determined in 225.

Embodiments of the present disclosure may include an apparatus. The apparatus may be a host device such as electronic device 102. The apparatus may include a wire connector configured to receive a connection to an external device. The wire connector may be a connector such as that for connection 128. The wire connector may be of any suitable protocol, such as USB. The external device may be of any suitable implementation, such as headset 104, and may include a speaker configured to output audible sounds. The external device may include other input and output mechanisms, and may provide input to the apparatus. The apparatus may include a connection detection circuit. The connection detection circuit may be implemented by analog circuitry, digital circuitry, instructions for execution by a processor, or any suitable combination thereof. The connection detection circuit may be configured to determine whether the external device has connected to the apparatus through the wire connector. The apparatus may include an output test circuit. The output test circuit may be implemented by analog circuitry, digital circuitry, instructions for execution by a processor, or any suitable combination thereof. For example, the output test circuit may include one or more of processor 134, test input circuit 108, RP 116, and switch 118. Moreover, the output test circuit may include other elements, not shown, such as additional processors. The output test circuit may be configured to, upon detection of a connection to the external device, issue a test signal to the external device, evaluate a response to the test signal, and determine an identity of the external device based upon the response to the test signal. The response may be based upon a resistance value within the external device. The test signal may be of a known voltage or current. The determination of the identity of the external device may be implicit or explicit. In an implicit determination, settings for the external device may be chosen without specifically identifying a model or other identity of the external device.

In combination with any of the above embodiments, the response to the test signal may be a measured value of current or voltage across an identifier resistor in the external device. The identifier resistor may be of a resistance value unique to the external device or a model of the external device.

In combination with any of the above embodiments, the output test circuit may be further configured to apply audio settings to input or output of the external device based upon the response to the test signal. The audio settings may be specific to an identity of the external device, such as a model of the external device.

In combination with any of the above embodiments, the apparatus may further include an audio output port (such as audio I/O 112) configured to issue audio signals for output by the external device. The output test circuit may be further configured to, while issuing the test signal to the external device, disable the audio output port.

In combination with any of the above embodiments, the output test circuit may be further configured to, while issuing the test signal to the external device, connect a pull-up resistor to the external device through the connection to form a voltage divider circuit with the resistance value within the external device. The output test circuit may be further configured to evaluate the response to the test signal by evaluating a voltage drop across the resistance value within the external device.

In combination with any of the above embodiments, the output test circuit may be further configured to determine the identity of the external device by determining a model of the external device based on the response to the test signal.

In combination with any of the above embodiments, the test circuit may be further configured to, upon determining that the response to the test signal does not correspond to a known external device, apply default audio settings to input or output of the external device.

Embodiments of the present disclosure may include another apparatus. The other apparatus may implement the external device of any of the above apparatuses, and may include, for example, a headset or other output or input/output device, such as headset 104. The other apparatus may include a speaker configured to output audible sounds, such as speaker 126. The other apparatus may also include input mechanisms such as microphones. The other apparatus may include a wire connector configured to receive a connection to a host device (such as electronic device 102) and receive test signals to identify the apparatus. The other apparatus may an identifier resistor, such as RID 122, connected between an input to the speaker and ground, wherein a resistance value of the identifier resistor is configured to identify the apparatus in response to the test signals.

In combination with any of the above embodiments, the apparatus may include a capacitor, such as capacitor 124, connected between the identifier resistor and the input to the speaker.

In combination with any of the above embodiment, the capacitor may be configured to prevent the speaker resistance from being measured. The test signal may be issued by the host device in a test mode. The test mode may be to identify the apparatus using the resistance value of the identifier resistor.

In combination with any of the above embodiments, the capacitor may be configured to allow audio signals to reach the speaker, the audio signals to be issued by the host device in a normal mode, the normal mode to allow the apparatus to be used for output by the host.

In combination with any of the above embodiments, the identifier resistor is configured to be connected between the input to the speaker and ground during both a test mode and a normal mode. In the test mode, the identifier resistor is configured to provide a response to the test signals. In the normal mode, the speaker is configured to output the audible sounds.

Those in the art will understand that a number of variations may be made in the disclosed embodiments, all without departing from the spirit and scope of the invention, which is defined solely by the appended claims.

What is claimed is:

1. An apparatus, comprising:

a wire connector configured to receive a connection to an external device, the external device to include a speaker configured to output audible sounds and a capacitor connected between an identifier resistor and an input to the speaker;

a connection detection circuit configured to determine whether the external device has connected to the apparatus through the wire connector; and an output test circuit configured to, upon detection of the connection to the external device:

issue a test signal to the external device;

evaluate a response to the test signal, the response based upon a resistance value within the external device; and determine an identity of the external device based upon the response to the test signal, wherein the capacitor in the external device is configured to prevent measurement of speaker resistance by the test signal.

2. The apparatus of claim 1, wherein the response to the test signal is a measured value of current or voltage across the identifier resistor in the external device.

3. The apparatus of claim 1, wherein the output test circuit is further configured to apply audio settings to input or output of the external device based upon the response to the test signal.

4. The apparatus of claim 1, wherein:

the apparatus further includes an audio output port configured to issue audio signals for output by the external device; and the output test circuit is further configured to, while issuing the test signal to the external device, disable the audio output port.

5. The apparatus of claim 1, wherein the output test circuit is further configured to, while issuing the test signal to the external device:

connect a pull-up resistor to the external device through the connection to form a voltage divider circuit with the resistance value within the external device; and evaluate the response to the test signal by evaluating a voltage drop across the resistance value within the external device.

6. The apparatus of claim 1, wherein the output test circuit is further configured to determine the identity of the external device by determining a model of the external device based on the response to the test signal.

7. The apparatus of claim 1, wherein the test circuit is further configured to, upon determining that the response to the test signal does not correspond to a known external device, apply default audio settings to input or output of the external device.

8. An apparatus, comprising:

a speaker configured to output audible sounds;

a wire connector configured to receive a connection to a host device and receive test signals to identify the apparatus;

an identifier resistor connected between an input to the speaker and ground; and a capacitor connected between the identifier resistor within the apparatus and the input to the speaker, wherein a resistance value of the identifier resistor is configured to identify the apparatus in response to the test signals, and wherein the capacitor is configured to prevent measurement of speaker resistance by the test signals.

9. The apparatus of claim 8, wherein the test signals are issued by the host device in a test mode, the test mode to identify the apparatus using the resistance value of the identifier resistor.

10. The apparatus of claim 8, wherein the capacitor is configured to allow audio signals to reach the speaker, the audio signals to be issued by the host device in a normal mode, the normal mode to allow the apparatus to be used for output by the host device.

11. The apparatus of claim 8, wherein:

the identifier resistor is configured to be connected between the input to the speaker and ground during both a test mode and a normal mode;

in the test mode, the identifier resistor is configured to provide a response to the test signals; and in the normal mode, the speaker is configured to output the audible sounds.

12. A method, comprising:

determining whether a connection has been made to an external device through a wire connector, the external device to include a speaker configured to output audible sounds and a capacitor connected between an identifier resistor within the external device and an input to the speaker; and upon detection of the connection to the external device:

issuing a test signal to the external device;

evaluating a response to the test signal, the response based upon a resistance value within the external device; and determining an identity of the external device based upon the response to the test signal, wherein the capacitor is configured to prevent measurement of speaker resistance by the test signal.

13. The method of claim 12, wherein the response to the test signal is a measured value of current or voltage across the identifier resistor in the external device.

14. The method of claim 12, further comprising applying audio settings to input or output of the external device based upon the response to the test signal.

15. The method of claim 12, further comprising, while issuing the test signal to the external device, disabling an audio output port, the audio output port to issue audio signals for output by the external device.

16. The method of claim 12, further comprising:

while issuing the test signal to the external device:

connecting a pull-up resistor to the external device through the connection to form a voltage divider circuit with the resistance value within the external device; and evaluating the response to the test signal by evaluating a voltage drop across the resistance value within the external device.

17. The method of claim 12, further comprising determining the identity of the external device by determining a model of the external device based on the response to the test signal.

18. The method of claim 12, further comprising, upon determining that the response to the test signal does not correspond to a known external device, applying default audio settings to input or output of the external device.

19. A method, comprising:

receiving a connection to a host device and receiving test signals to identify an apparatus, the apparatus including a speaker to output audible sounds;

connecting an identifier resistor within the apparatus between an input to the speaker and ground, wherein a resistance value of the identifier resistor identifies the apparatus in response to the test signals;

connecting a capacitor between the identifier resistor within the apparatus and the input to the speaker; and preventing measurement of speaker resistance by the test signals using the capacitor.

20. The method according to claim 19, further comprising the host device issuing the test signals in a test mode, the test mode to identify the apparatus using the resistance value of the identifier resistor.

21. The method according to claim 20, further comprising:

connecting the identifier resistor between the input to the speaker and ground during both the test mode and a normal mode;

in the test mode, providing, by the identifier resistor, a response to the test signals; and in the normal mode, outputting, through the speaker, the audible sounds.

22. The method according to claim 19, further comprising allowing audio signals to reach the speaker in a normal mode, the normal mode to allow the apparatus to be used for output by the host device.

* * * * *